US009745162B2

(12) United States Patent
Swanson et al.

(10) Patent No.: US 9,745,162 B2
(45) Date of Patent: Aug. 29, 2017

(54) APPARATUS FOR GUIDING A MOVING WEB

(71) Applicant: 3M INNOVATIVE PROPERTIES COMPANY, St. Paul, MN (US)

(72) Inventors: Ronald P. Swanson, Woodbury, MN (US); Daniel H. Carlson, Arden Hills, MN (US); James N. Dobbs, Woodbury, MN (US); Karl K. Stensvad, Inver Grove Heights, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 74 days.

(21) Appl. No.: 14/356,905

(22) PCT Filed: Dec. 7, 2012

(86) PCT No.: PCT/US2012/068376

§ 371 (c)(1),
(2) Date: May 8, 2014

(87) PCT Pub. No.: WO2013/090134

PCT Pub. Date: Jun. 20, 2013

(65) Prior Publication Data

US 2014/0319194 A1 Oct. 30, 2014

Related U.S. Application Data

(60) Provisional application No. 61/570,914, filed on Dec. 15, 2011.

(51) Int. Cl.
*B65H 23/038* (2006.01)
*B65H 23/032* (2006.01)

(52) U.S. Cl.
CPC ..... *B65H 23/038* (2013.01); *B65H 23/0326* (2013.01); *B65H 2404/15212* (2013.01);
(Continued)

(58) Field of Classification Search
CPC .. B65H 23/038; B65H 23/26; B65H 23/0326; B65H 2404/15212; B65H 23/016;
(Continued)

(56) References Cited

U.S. PATENT DOCUMENTS 3,436,002 A 4/1969 Racine
3,568,904 A 3/1971 Kurz
(Continued)

FOREIGN PATENT DOCUMENTS

CN 102001543 4/2011
JP S52-120942 10/1977
(Continued)

OTHER PUBLICATIONS

Shelton, Lateral Dynamics of a Moving Web—Static Behaviour, Doctor of Philosophy, Oklahoma State University, Jul. 1968, 210 pages.

(Continued)

*Primary Examiner* — Michael McCullough
(74) *Attorney, Agent, or Firm* — Yufeng Dong; Adrian L. Pishko

(57) ABSTRACT

An apparatus (20) for steering a web (22), including a web path having at least one steering roller (24) and an exit roller (26), each having a mount; wherein the steering roller(s) (26) each have an axis of rotation and wherein the mounts for the steering roller(s) (26) can pivot those axes with a total of two degrees of freedom. An array (30) comprising a plurality of sensors (30*a*) for monitoring the position of the web (22) is present connected to a controller so as to determine the position and angular orientation of the web (22). The controller adjusts the pivot(s) of the mount(s) so as to control the angular orientation and the lateral position of the web (22) at a particular point along the web path.

8 Claims, 11 Drawing Sheets

(52) U.S. Cl.
CPC .. *B65H 2511/242* (2013.01); *B65H 2553/416* (2013.01); *B65H 2553/80* (2013.01)

(58) Field of Classification Search
CPC B65H 23/048; B65H 23/1882; B65H 23/192; B65H 2553/416
USPC ..... 226/21, 28
See application file for complete search history.

(56) References Cited

U.S. PATENT DOCUMENTS

| | | | | |
|---|---|---|---|---|
| 3,570,735 | A | 3/1971 | Kurz | |
| 3,596,817 | A | 8/1971 | Morse | |
| 3,608,796 | A | 9/1971 | Morse | |
| 3,615,048 | A | 10/1971 | Martin | |
| 3,913,813 | A | 10/1975 | Morse | |
| 3,958,736 | A | 5/1976 | Pounds | |
| 3,986,650 | A | 10/1976 | Swanke | |
| 4,061,222 | A | 12/1977 | Rushing | |
| 4,453,659 | A | 6/1984 | Torpey | |
| 4,462,676 | A | 7/1984 | Shimura | |
| 4,572,417 | A | 2/1986 | Joseph | |
| 4,655,096 | A | 4/1987 | Westhaver | |
| 4,664,303 | A | 5/1987 | Morse | |
| 4,893,740 | A | 1/1990 | Hediger | |
| 4,913,328 | A * | 4/1990 | Schulz | G11B 15/602 226/190 |
| 4,961,089 | A | 10/1990 | Jamzadeh | |
| 5,019,864 | A | 5/1991 | Blanding | |
| 5,141,585 | A | 8/1992 | Shinno | |
| 5,225,877 | A | 7/1993 | Wong | |
| 5,387,962 | A | 2/1995 | Castelli | |
| 5,558,263 | A * | 9/1996 | Long | B65H 23/035 226/114 |
| 5,667,123 | A | 9/1997 | Fukuda | |
| 5,711,470 | A | 1/1998 | Thompson | |
| 5,803,334 | A * | 9/1998 | Patel | B65H 23/0204 226/45 |
| 5,833,106 | A | 11/1998 | Harris | |
| 5,989,368 | A | 11/1999 | Tillander | |
| 6,164,201 | A | 12/2000 | Burke | |
| 6,584,900 | B2 | 7/2003 | De vroome | |
| 6,766,934 | B2 | 7/2004 | Ziegelaar | |
| 7,267,255 | B1 | 9/2007 | Young | |
| 7,284,486 | B2 | 10/2007 | Winter | |
| 7,296,717 | B2 | 11/2007 | Swanson | |
| 7,590,378 | B2 * | 9/2009 | Fuchs | B41J 11/002 226/21 |
| 8,317,191 | B2 * | 11/2012 | deJong | B65H 9/002 271/227 |
| 2004/0239027 | A1 * | 12/2004 | Trovinger | B65H 7/08 271/227 |
| 2006/0147232 | A1 | 7/2006 | Fuchs | |
| 2006/0208416 | A1 * | 9/2006 | Dejong | B65H 9/002 271/228 |
| 2007/0088090 | A1 | 4/2007 | Hsu et al. | |
| 2008/0006992 | A1 * | 1/2008 | Inoue | B65H 9/002 271/228 |
| 2008/0067311 | A1 | 3/2008 | Wagner | |
| 2008/0067371 | A1 | 3/2008 | Kurihara et al. | |
| 2009/0066945 | A1 | 3/2009 | Wang | |
| 2009/0067273 | A1 | 3/2009 | Koike et al. | |
| 2010/0187277 | A1 | 7/2010 | Carlson | |
| 2011/0129277 | A1 | 6/2011 | Muir | |

FOREIGN PATENT DOCUMENTS

| | | |
|---|---|---|
| JP | 02-089757 | 3/1990 |
| JP | 2003-201665 | 7/2003 |
| WO | WO 2008-088650 | 7/2008 |
| WO | WO 2008-157588 | 12/2008 |
| WO | WO 2008-157619 | 12/2008 |
| WO | WO 2008-157623 | 12/2008 |
| WO | WO 2010-077592 | 7/2010 |
| WO | WO 2010-077719 | 7/2010 |
| WO | WO 2011-137988 | 11/2011 |
| WO | WO 2014-123766 | 8/2014 |

OTHER PUBLICATIONS

International Search Report for PCT International Application PCT/US2012/068376 mailed on Mar. 8, 2013, 5 pages.

* cited by examiner

APPARATUS FOR GUIDING A MOVING WEB

CROSS REFERENCE TO RELATED APPLICATIONS

This application is a national stage filing under 35 U.S.C. 371 of PCT/US2012/068376, filed Dec. 7, 2012, which claims priority to Provisional Application No. 61/570,914, filed Dec. 15, 2011, the disclosure of which is incorporated by reference in its/their entirety herein.

BACKGROUND

Generally, there are two types of guide systems for controlling a transverse position of a moving web. A first type of guide system for controlling a transverse position of a moving web is a passive system. An example of a passive system is a crowned roller, also called a convex roller, having a greater radius in the center than at the edges. Crowned rollers are effective at controlling webs that are relatively thick in relation to the width of the web such as sanding belts and conveyor belts. Another passive type of guide system is a tapered roller with a flange. The taper on the roller directs the web towards the flange. The web edge contacts the flange and thereby controls the transverse position of the web. A tapered roller with a flange is commonly used to control the lateral position of a narrow web, such as a videotape.

However, a passive guide system cannot guide wide, thin webs because, depending on the type of passive guide system, either the edge of the web tends to buckle or the web tends to develop wrinkles. To effectively control a wide, thin web an active guide system is required.

A typical active guide system includes a sensing device for locating the position of the web, a mechanical positioning device, a control system for determining an error from a desired transverse location and an actuator that receives a signal from the control system and manipulates the mechanical positioning device. A typical control system used for actively guiding a thin, wide web is a closed loop feedback control system.

Typically, a web to be processed has been previously wound into a roll. During the winding process, the web is not perfectly wound and typically has transverse positioning errors in the form of a zigzag or a weave. When the web is unwound, the zigzag or weave errors recur causing transverse web positioning problems.

It is known to control a moving web in relation to a selected transverse position by positioning a first positioning guide proximate a second positioning guide, then passing the web through the first positioning guide to reduce angular and transverse position errors. The web is then passed through the second positioning guide where the second positioning guide positions the moving web independently of the first positioning guide with a mechanism having zero-backlash. The transverse location of the moving web is sensed at the second positioning guide with a sensor and the transverse location of the web at the second positioning guide is transmitted to a controller. The controller then manipulates a zero-backlash actuator so as to control the transverse position of the web.

SUMMARY

Although with known techniques the transverse position of the web can be controlled to a high tolerance, it is not possible to control both the transverse position of the web at a selected point along the web path and control the angular orientation of the web at that point. For some applications, control of the angular orientation as well would be very desirable. The present invention generally relates to a method and an apparatus for controlling a moving web. More specifically, the present invention relates to a web guide apparatus having the ability to control both the lateral position of the web at a control location (chosen position along the web path), as well as the web's angular orientation at the control location.

It has now been determined that it is possible to control both the transverse position of a moving web at the same time and at the same place along the web path where the angular orientation of the web is also controlled. This is accomplished in part by providing a steering roller that has the ability to move with two degrees of freedom. Such control is of great advantage when, e.g. the web is about to be patterned with very fine features that are positioned in registration with other features on the web.

Hence, in one embodiment, the invention resides in an apparatus for steering a web comprising: a web path comprising at least one steering roller and an exit roller, each having a mount; wherein the at least one steering roller has an axis of rotation and wherein the mount for the at least one steering roller can pivot and/or translate the axis of rotation with a total of two degrees of freedom; an array comprising a plurality of position sensors for monitoring the position of the web; a controller connected to the array for determining the lateral position and angular orientation of the web; and two actuators operably connected to the at least one steering roller for positioning the steering roller to control the angular orientation and the lateral position of the web at a particular point along the web path.

In some convenient embodiments, the apparatus is such that the web path has one steering roller and the mount for that steering roller can pivot in the requisite two degrees of freedom. In other convenient embodiments, the apparatus is such that the web path has a first and a second steering roller, and the mounts for the first and second steering rollers can each pivot in a first and a second degree of freedom, respectively.

In some convenient embodiments, the first degree of freedom is a yaw angle around a yaw-axis perpendicular to the surface of the web at a predetermined point. Further, in some convenient embodiments the second degree of freedom is a roll angle around a roll-axis parallel to the surface of the web at the predetermined point or possibly at different predetermined point.

While an array having a plurality of position sensors is needed, some convenient embodiments include four sensors. This is because the relevant equations for controlling the web transverse position and angular orientation require four boundary conditions for an exact solution.

In another embodiment, the invention resides in a method of steering a web comprising: providing a plurality of position sensors adjacent to the web; calculating the angular orientation and lateral position of the web by solving more than one position equation using a general solution for the lateral dynamics of a moving web; moving a steering roller about a yaw-axis perpendicular to the surface of the web; moving the steering roller about a roll-axis parallel to the surface of the web; and guiding the web to a chosen position along a web path downstream of the steering roller.

Those skilled in the art will more fully understand the nature of the invention upon consideration of the remainder of the disclosure, including the Detailed Description, the Examples, and the appended claims.

BRIEF DESCRIPTION OF THE DRAWINGS

It is to be understood by one of ordinary skill in the art that the present discussion is a description of exemplary embodiments only, and is not intended as limiting the broader aspects of the present disclosure, which broader aspects are embodied in the exemplary construction.

Figure 1:
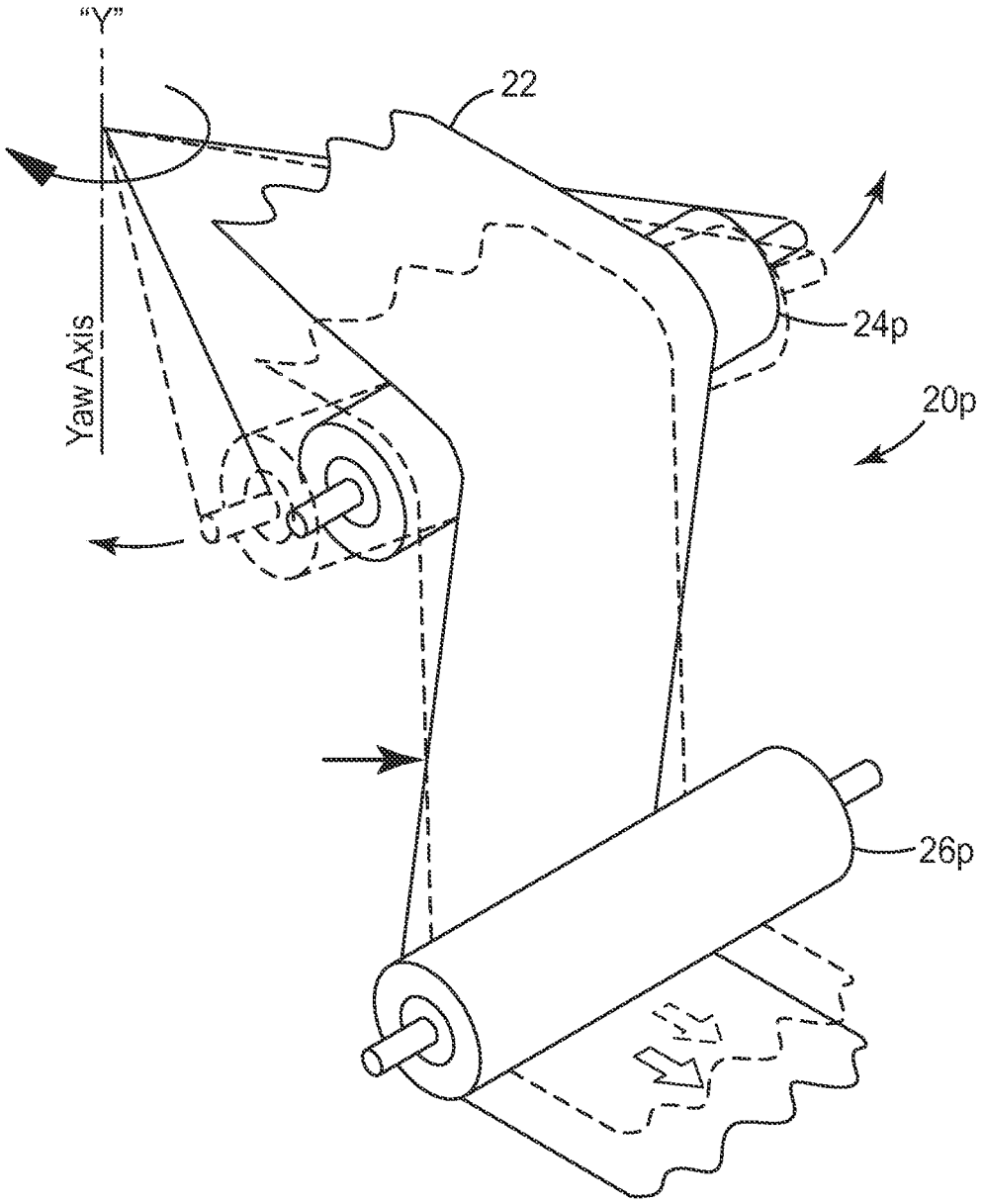
FIG. 1 Prior Art
FIG. 1 is a perspective schematic view of a web steering apparatus according to the prior art, illustrating certain limitations on its performance.

Repeated use of reference characters in the specification and drawings is intended to represent the same or analogous features or elements of the disclosure.

DETAILED DESCRIPTION

Referring now to FIG. 1, a perspective schematic view of a web steering apparatus 20*p* for guiding a web according to the prior art is illustrated. The web 22 is conveyed around steering roller 24*p* and exit roller 26*p*. Two of many possible orientations of web 22 are depicted: one in solid lines, and another in phantom lines. Steering roller 24*p* is pivotable around a yaw-axis "Y" and two of many possible orientations are also depicted: one in solid lines, and another in phantom lines, and each pertain to the respective orientations of web 22. A black arrow depicting a web edge sensor between the two rollers indicates the position along the web path which is being controlled by the web steering apparatus 20*p* and the lateral positions of the two web paths are identical at that point. However, the angular orientations of the two web paths at the control point are different, and among other consequences, the lateral control deteriorates as the web moves in the machine direction away from the control point. Thus, downstream of the control point depicted by the black arrow, the lateral positions of the two web paths shown by grey and white arrows are no longer congruent.

Figure 2:
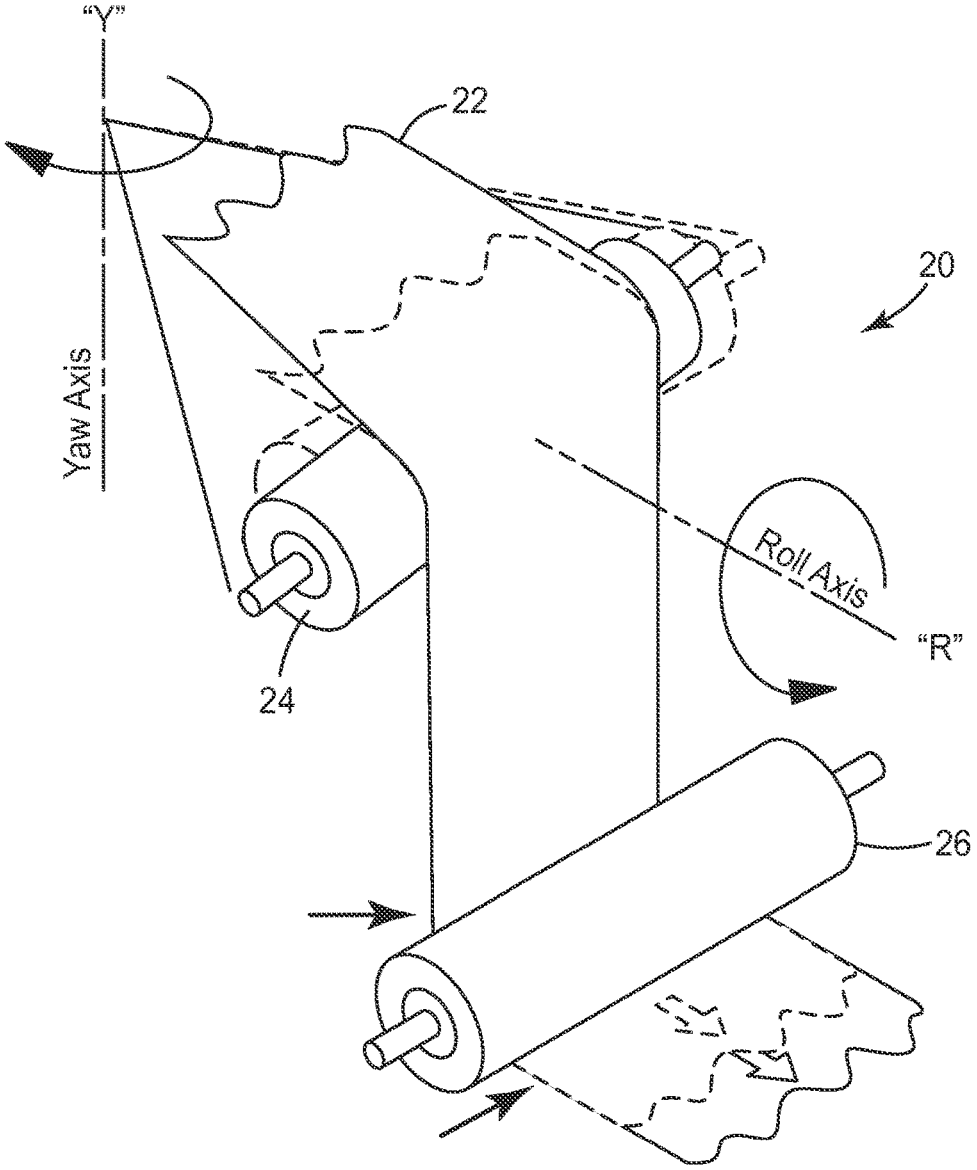
FIG. 2 is a perspective schematic view of a web steering apparatus according to one embodiment of the present invention.

Referring now to FIG. 2, a perspective schematic view of a web steering apparatus 20 for guiding a web according to the present invention is illustrated in a steering guide embodiment. Once again, the web 22 is conveyed around steering roller 24 and exit roller 26 along a web path. And once again, two of many possible orientations of web 22 are depicted: one in solid lines, and another in phantom lines. But this time, steering roller 24 is pivotable around both a yaw-axis "Y" and a roll-axis "R". Two of many possible orientations of steering roller 24 are depicted: one in solid lines, and another in phantom lines, and each pertain to the respective orientations of incoming web 22. Arrows indicate two of the many possible positions along the web path to which the steering roller can control the angular orientation and lateral position of the web at that particular point. In other words, the lateral positions of the web paths are identical at control points both before and after the exit roller 26 irrespective of the incoming angular orientation of the web prior to the steering roller. Since the angular orientation of the both incoming webs at the control points have been corrected to be the same, the same lateral control persists as the web 22 passes the exit roller 26 and beyond regardless of the lateral or angular orientation of the incoming web prior to steering roller 24.

In order to achieve best results with the present invention, the steering roller 24 that is pivotable about the roll-axis requires control of very small angles. This desirably includes backlash free rotational and actuation mechanics such as preloaded bearings or bushings, or mechanical flexures. It also desirably uses very accurate measurement of very small angles as the web approaches the steering roller 24 since web angular rotations can be on the order of 0.0001 radians.

It has now been discovered that an accurate positional and angular model of the web's shape can be calculated by using more than one position sensor. Chapter 2 of J. J. Shelton's 1969 thesis at Oklahoma State University, "Lateral Dynamics of a Moving Web," derives the general shape of a tensioned web as a 4th order differential equation. The general solution of this axially tensioned beam has four constants of integration. Shelton went on to apply four steady state boundary conditions to the general solution to find the particular solution for a web at steady state. Shelton described this steady state condition as the "static web shape" because the web's lateral motion is static, but it may be moving in the machine direction.

The inventors have discovered Shelton's general solution may be applied to a web steering guide and solved by using four position sensors as inputs to generate four separate position equations (one for each sensor location), which can then be solved simultaneously to obtain an accurate model of the web's lateral position at that instant in time. That modeled solution can then be differentiated to obtain an accurate angular orientation (rotation) model of the web in that span. This lateral position and angular rotation calculated data can be used by the controller to very accurately control both the web's lateral position, as well as the web's angular orientation at a point later in the process by adjusting the steering roller(s).

Shelton also shows that this general solution degenerates toward a cubic polynomial as the tension drops toward zero, or as the beam stiffness goes toward infinity. The general solution degenerates toward a two degree of freedom sloped line as the beam stiffness drops toward zero or as the tension goes toward infinity, causing the beam to act more like a string. Shelton also formulates the general solution of an axially tensioned beam with significant shear deflection, which would be appropriate for short web spans. Thus, the length of the span, the width of the web, and the tension in the span may be used to determine which of the general solutions is most appropriate to model the web at that web span. As such, a tension sensor can be fed into the controller to use as a selection tool to determine which general solution should be chosen for modeling the web's position and orientation.

Furthermore, one may assume one or more boundary conditions in the equations to decrease the degrees of freedom needed to estimate the shape of the web (and simultaneous equations required to be solved). Therefore, measurements with three or two position sensors, with or without time derivatives, can also be used. Use of such techniques may result in a degraded knowledge of the instantaneous lateral position and angular rotation of the web, but can be entirely suitable for many web processing applications where ultimate precision is unnecessary. Therefore calculating the angular orientation and lateral position of the web by solving more than one position equation using a general solution for the lateral dynamics of a moving web may be accomplished by inputting at least two, at least three, or at least four position sensor measurements into the controller and solving two, three, or four position equations using a general solution for the lateral dynamics of a moving web. Contrariwise, five or more sensors can be used in association with known curve fitting algorithms such as least squares, to obtain a statistically improved fit of a fourth order general solution, reducing the deleterious effect of sensor noise. As such, two, three, four, five or more position equations using the general solution for the lateral dynamics of a moving web can be solved simultaneously to model the shape (lateral and angular orientation) of the web.

The precision of the sensors affects the accuracy of the lateral position and angle control that can be achieved. Area scan or line scan cameras from various vendors, or LED/CCD optical micrometer position sensors are considered to be suitable for use.

Figure 3:
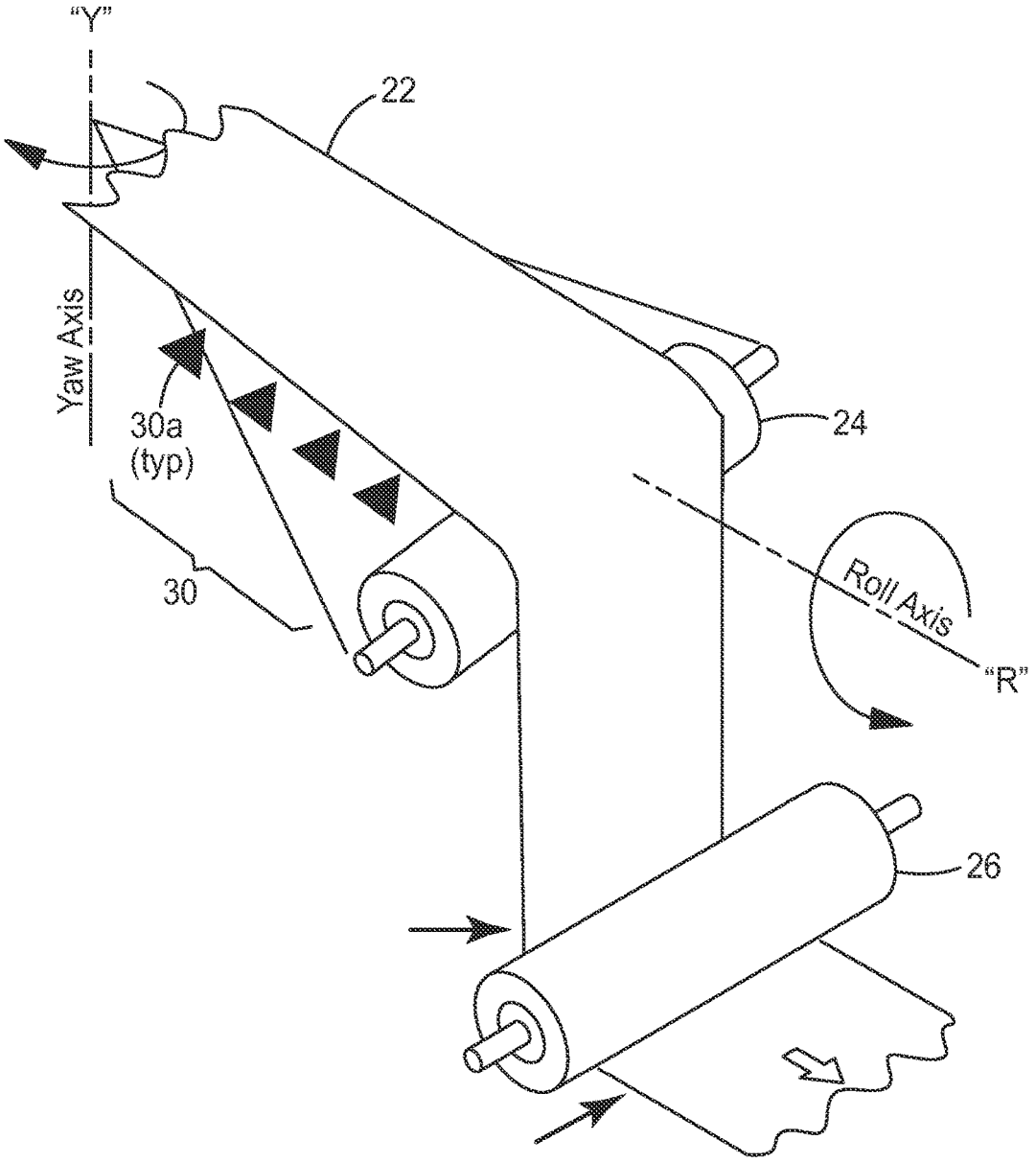
FIG. 3 is a perspective schematic view of the web steering apparatus system of FIG. 2 with one positioning of an array of position sensors.

Referring now to FIG. 3, a perspective schematic view of the web steering apparatus of FIG. 2 is illustrated with one positioning of an array 30 of position sensors 30*a*. In this embodiment, the array 30 has four position sensors 30*a*; per the discussion above, four is a convenient number. The array 30 is positioned upstream of the steering roller 24. In contrast, and referring now for FIG. 4, a perspective schematic view of the web steering apparatus of FIG. 2 is illustrated with an alternate positioning of an array 30' of position sensors 30*a*. The array 30' is positioned downstream of the steering roller 24. Either positioning can be effective to control the lateral position and angular orientation of the web 22. Other variations of sensor position are operable and considered within the scope of the invention, e.g. some sensors upstream and others downstream of the steering roller 24. Alternatively, a camera system could be provided to obtain the data from several points simultaneously.

Figure 4:
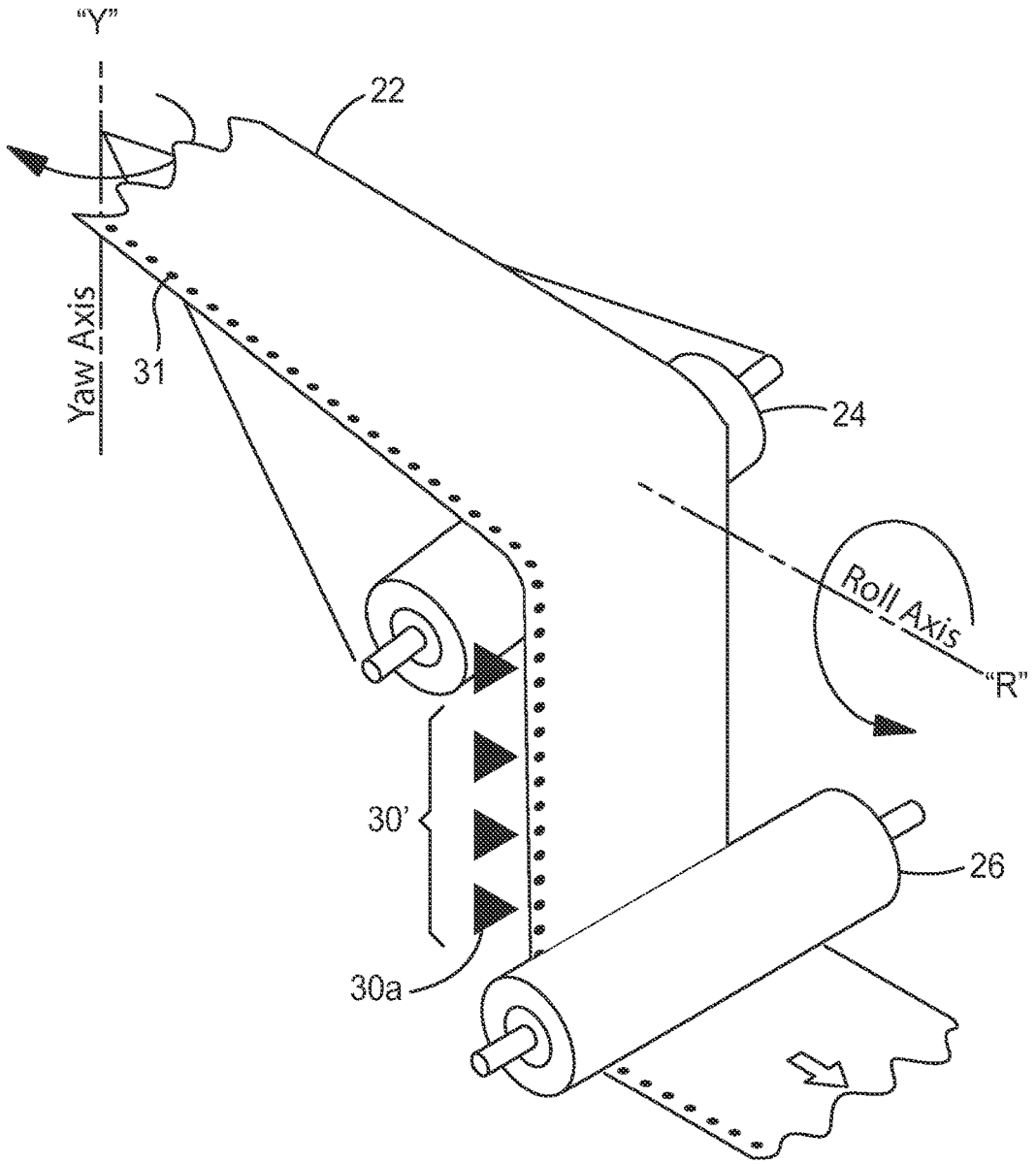
FIG. 4 is a perspective schematic view of the web steering apparatus of FIG. 2 with an alternate positioning of an array of position sensors.

Numerous techniques are known for sensing the position of the edge of a web. These include optical, ultrasonic, fluidic, and mechanical expedients. While any of these techniques can be used to effect in connection with the present invention, optical sensing in connection with a tracking fiducial applied directly to the web is considered particularly suitable. Referring to FIG. 4, the web 22 has a tracking fiducial 31 and the position sensors 30*a* monitor the lateral position of the tracking fiducial. Further information on such edge sensing systems can be found in copending and coassigned U.S. Patent publication 2010/0187277 "Systems and Methods for Indicating the Position of a Web"; copending and coassigned U.S. Patent publication US2009/067273 "Apparatus and Method for Making Fiducials on a Substrate"; copending and coassigned U.S. Patent publication US2009/066945 "Phase-locked Web Position Signal Using Web Fiducials"; copending and coassigned U.S. Patent publication US2007/088090 "Web Longitudinal Position Sensor"; copending and coassigned U.S. Patent publication US2008/067371 "Total Internal Reflection Displacement Scale"; and copending and coassigned U.S. Patent publication US2008/067311, "Systems and Methods for Fabricating Displacement Scales". With these techniques, continuous high signal to noise web position feedback with position resolutions of tens of nanometers is possible.

In situations where high web guiding accuracy levels are needed, it is often the case that some feature on that web needs to be guided relative to a process operation. For example, the structures on multiple layers of a semiconductor circuit on a web need to be precisely aligned. Therefore it is highly desirable to apply the tracking fiducials in conjunction with the first step in the process. This allows the later steps in the downstream processes to be aligned with the features that have been previously applied to the web. In addition, even if there is distortion (either temporary, due to local tension or temperature changes, or permanent due to the web being yielded by the process or transport), the fiducial applied to the web will be similarly affected. This allows for a more accurate tracking of the features.

Figure 5:
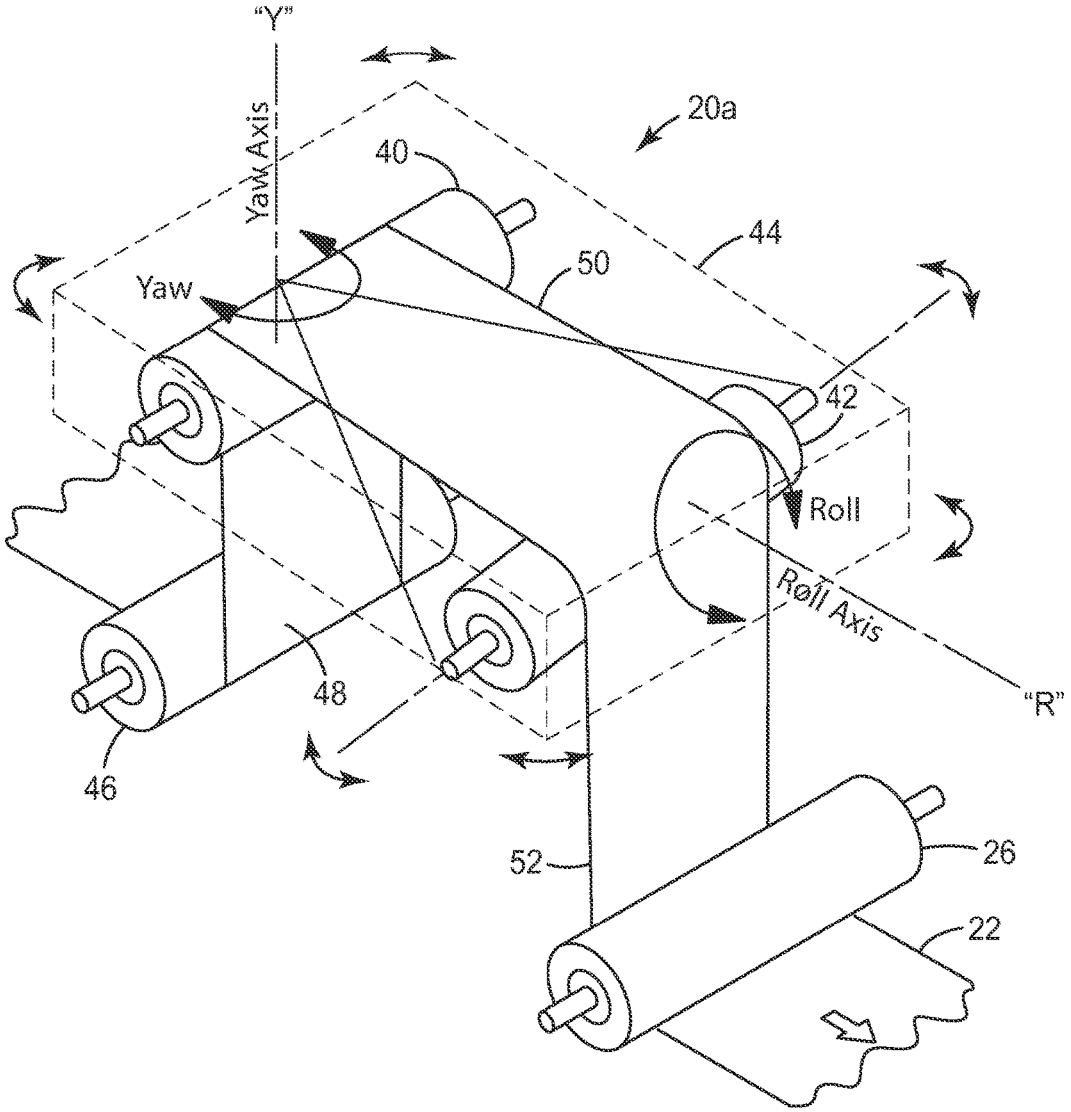
FIG. 5 is a perspective schematic view of an alternate embodiment of the web steering apparatus.

Referring now to FIG. 5, a perspective schematic view of an alternate web steering apparatus 20*a* for guiding a web is illustrated in a displacement guide embodiment. In this embodiment, the two degrees of freedom are divided among two different rollers. More specifically, this embodiment includes a first steering roller 40 and a second steering roller 42. In the depicted embodiment, the first steering roller 40 and the second steering roller 42 and some of the mechanisms that manipulate their orientation are conveniently all mounted on a yaw-axis rotation frame 44 (represented schematically in this Figure for visual clarity) that moves both rolls about the yaw-axis pivot point. Also conveniently present are an entrance roller 46 and an exit roller 26. Conceptually, this divides web 22 into three spans, an entrance span 48, a displacement frame span 50, and an exit span 52. An array of position sensors (equivalent to 30 in FIG. 3 or 4) will be present, and the individual sensors may be on one, or divided among more than one, of the three spans 48, 50 and 52. In the depicted embodiment, the first and second steering rollers 40, 42 have controlled freedom of movement about yaw-axis "Y," and second steering roller 42 has an additional controlled freedom of movement about roll-axis "R" provided for by a roll-axis frame (not shown) connecting the second steering roller 42 to the yaw-axis rotation frame 44. Together, the two steering rolls 40 and 42 can be effective to control both the lateral position and angular orientation of the web 22 to a chosen position along the web path downstream of the second steering roller 42.

Figure 6:
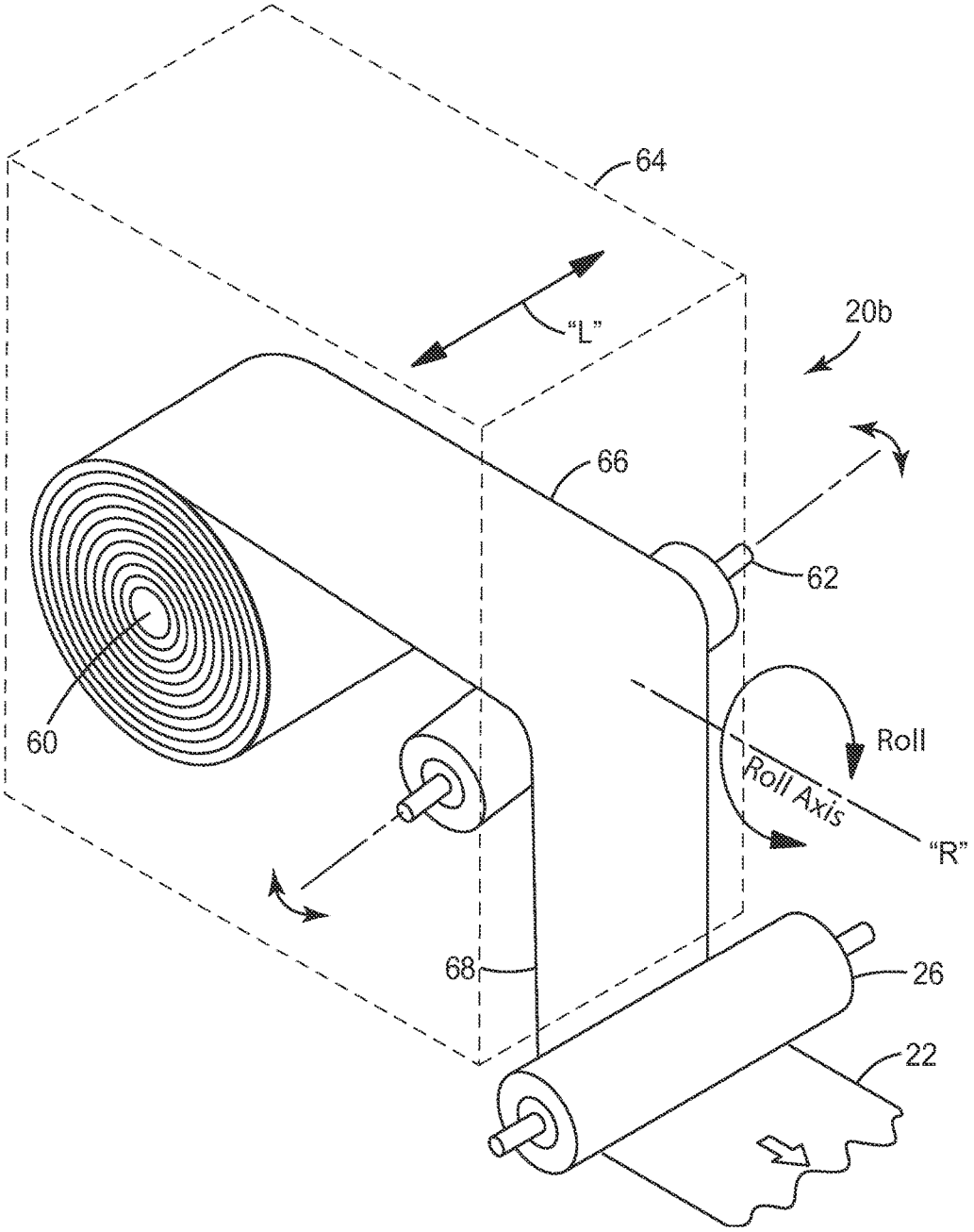
FIG. 6 is a perspective schematic view of another alternate embodiment of the web steering apparatus.

Referring now to FIG. 6, a perspective schematic view of an alternate web steering apparatus 20*b* for guiding a web is illustrated in a sidelay embodiment. As in the embodiment of FIG. 5, the two degrees of freedom are divided among two different rollers. However, in this case one of the degrees of freedom is translational motion in the cross-web direction. Further, in this embodiment, the roller with the translational degree of freedom does double duty as an unwind stand. More specifically, this embodiment includes an unwinding roll 60 and a steering roller 62. In the depicted embodiment, the unwind roll 60 and the steering roller 62 and some of the mechanisms that manipulate their orientation are conveniently all mounted on a laterally shifting frame 64, represented schematically in this Figure for visual clarity. Also conveniently present is an exit roller 26, not mounted on the shifting frame 64. Conceptually, this divides web 22 into two spans, an entrance span 66 and an exit span 68. An array of position sensors (equivalent to 30 in FIG. 3 or 4) will be present, and the individual sensors may be on one, or divided among the two spans 66 and 68. In the depicted embodiment, the unwind roll 60 and steering roller 62 both have controlled freedom of movement in the cross-web direction "L," and steering roller 62 has an additional controlled freedom of movement about roll-axis "R." The steering roller 62 is rotably mounted to the laterally shifting frame 64 for rotation about the roll-axis parallel to the surface of the unwinding web span 66. Together, the two steering rollers 60 and 62 can be effective to control both the lateral position and angular orientation of the web 22 guiding the web to a chosen position along the web path downstream of the steering roller 62.

Figure 7:
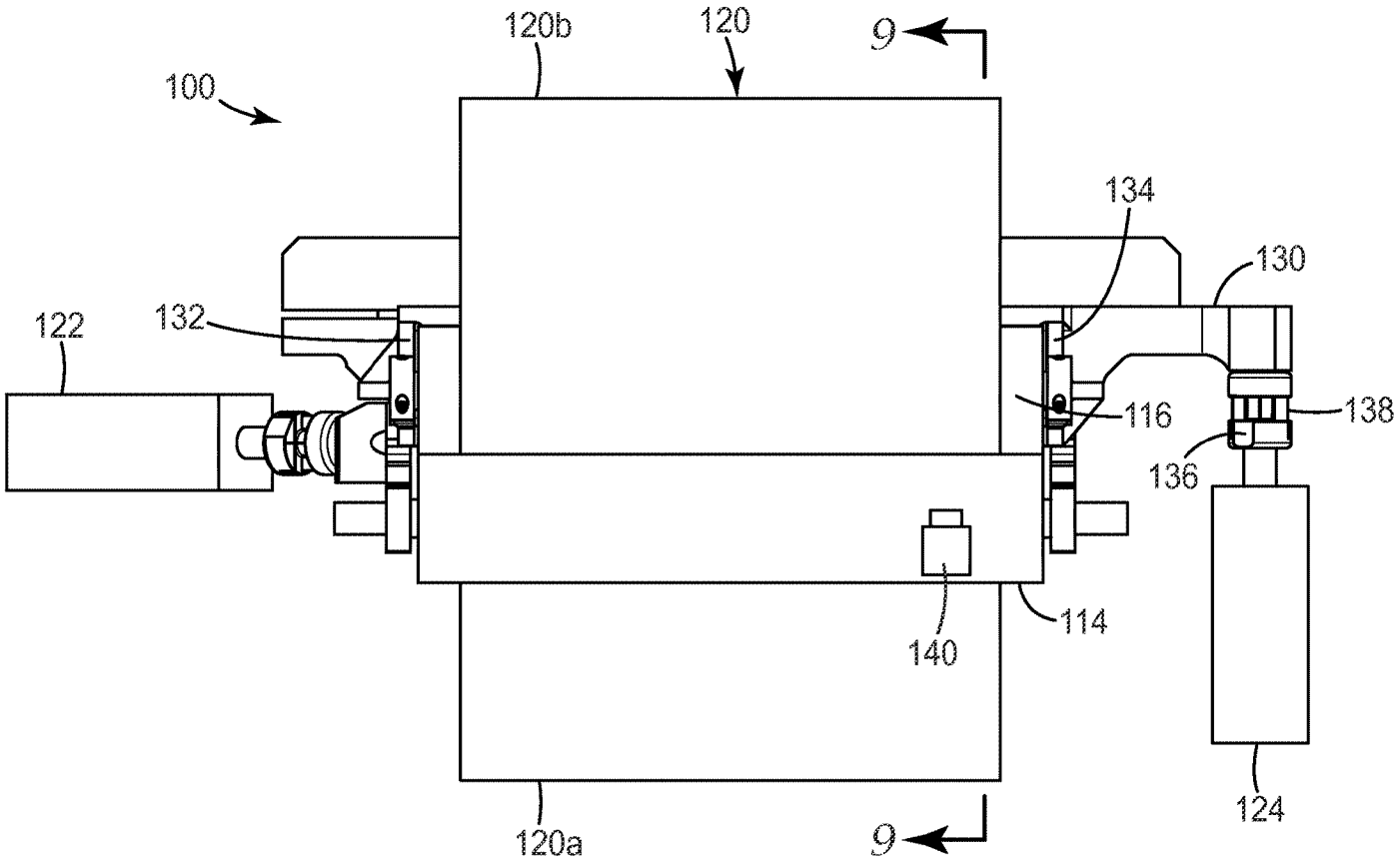
FIG. 7 is a front view of a particular embodiment of the web steering apparatus.

Referring now to FIG. 7, a front view of a particular embodiment of a web steering apparatus 100 for guiding a web 120 is illustrated. For visual clarity, some of the ordinary stands, supports, and brackets of conventional type that can be used to support the illustrated elements of web steering apparatus 100 have been omitted. In this view, the first steering roller 114 can be seen, but the second steering roller 116 is mostly hidden behind web 120. More specifically, 120*a* is the portion of the web 120 that is approaching the web steering apparatus 100, and 120*b* is the portion of the web 120 that is leaving the web steering apparatus 100 after having been steered.

In this particular embodiment, second steering roller 116 has two degrees of freedom. A yaw-axis actuator 122 and a roll-axis actuator 124 are present. Suitable actuators are linear ball screw actuators. The second steering roller 116 is mounted on a roll-axis frame 130 with bearing supports 132 and 134. The roll-axis frame 130 is in turn mounted on a yaw-axis rotation frame 135 (FIG. 10) providing the two degrees of freedom to roller 116. The yaw-axis rotation frame 135 comprises a plurality of flexures suspending a plate from a fixed support. The roll-axis frame 130 is manipulated by the roll-axis actuator 124 via a backlash-free linear coupler 136 such as a linear flexure coupling. Conveniently, the coupler 136 is rigid along the actuation axis, but uses flexures 138 to allow for actuator angular misalignment and lateral motion caused by rotation about the yaw-axis. Conveniently, the travel of the roll-axis actuator 124 is limited at the extremities by hard stops to assure coupling integrity. In this view, one of conveniently several, most conveniently four position sensors 140 can be seen. Others will be visualized in other FIGS. discussed below.

Figure 8:
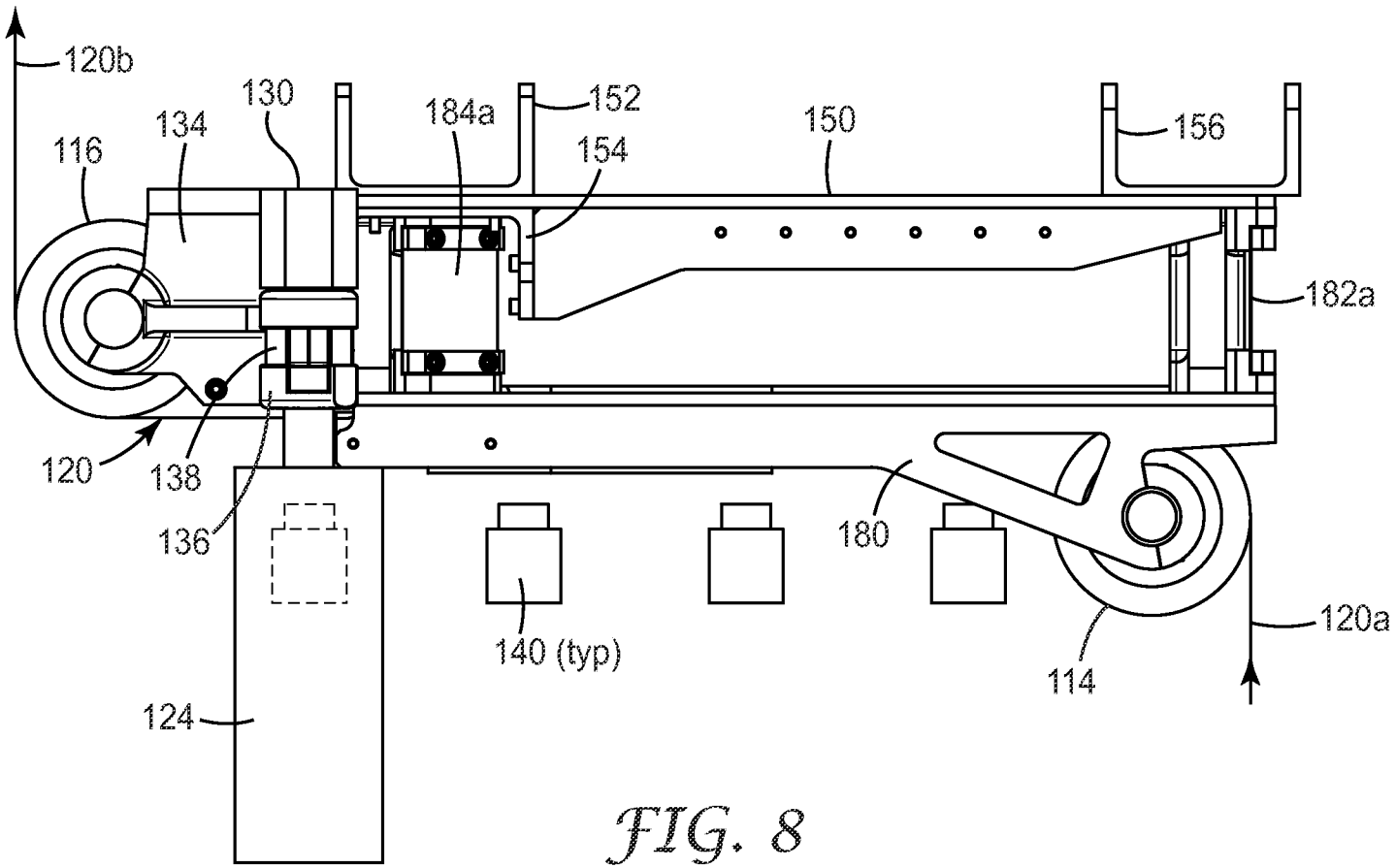
FIG. 8 is a side view of the web steering apparatus of FIG. 7.

Referring now to FIG. 8, a side view of the web steering apparatus 100 of FIG. 7 is illustrated. In this view, four position sensors 140 are shown spaced along the web located between the first and the second steering rollers with one of them depicted in dashed lines behind roll-axis actuator 124. In some convenient embodiments, the brackets (not shown) that support these position sensors 140 are adjustable so that the position sensors 140 can be accurately targeted on the web path between first steering roller 114 and second steering roller 116. Position sensors as previously described are suitable. Also in this view, platform 150 acts as a fixed support for positioning and holding the web steering apparatus in a web handling line is seen. Channels 152, 154, and 156 are conveniently attached to it to impart stiffness. Channels 154 and 156 are also a convenient point for fixing the web steering apparatus 100 relative to the ground and/or other apparatus intended to act on the web. The yaw-axis rotation frame 135 includes a plate 180 suspended from the platform 150 by two pairs of flexures, 182*a* and 182*b*, and 184*a*, and 184*b* (flexures 182*b* and 184*b* are hidden, but will be seen in FIG. 10). First steering roller 114 comprising a dead shaft roller is mounted to plate 180 by a split mounting ring.

Figure 9:
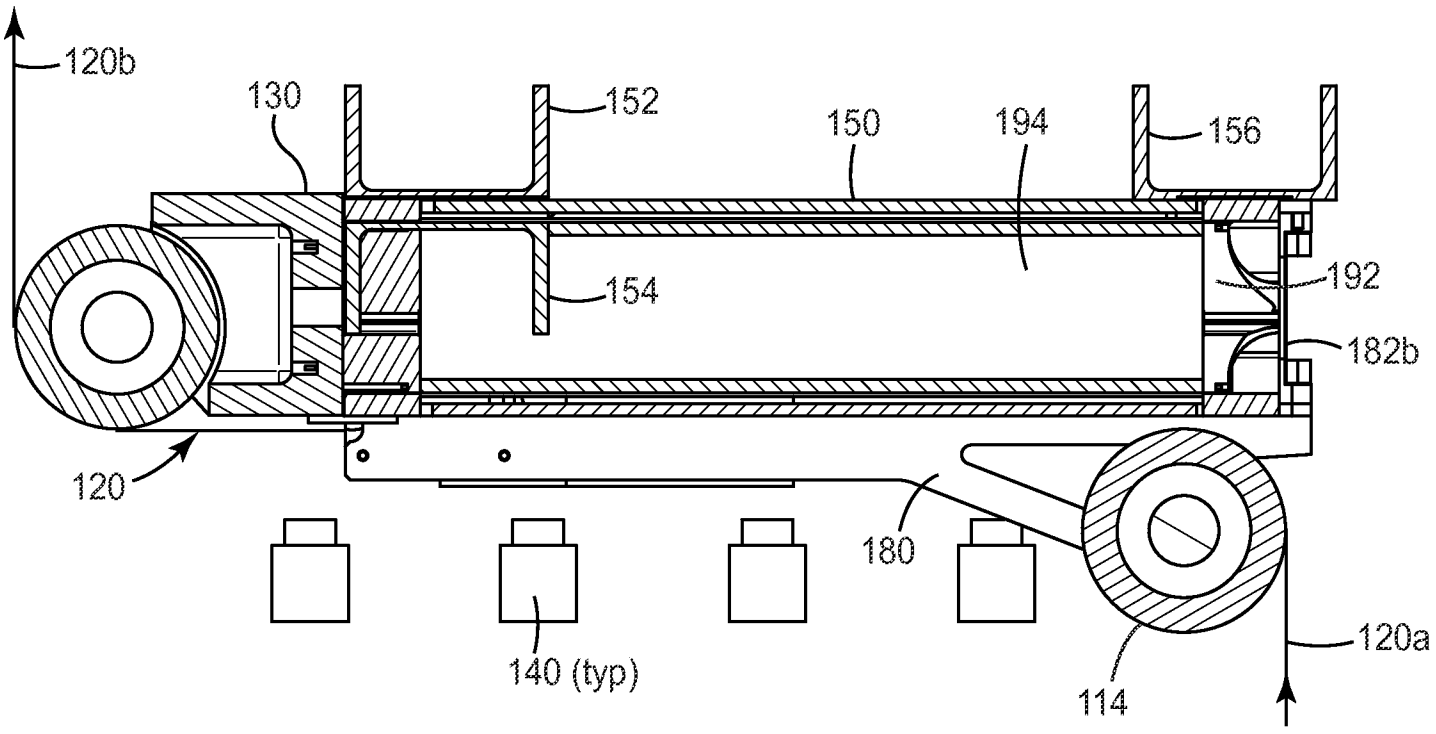
FIG. 9 is a cross-section side view of the web steering apparatus taken along section lines 9-9 of FIG. 7.

Referring now to FIG. 9, a cross-section side view, taken along section lines 9-9 of the web steering apparatus 100 of FIG. 7 is illustrated. In this view flexure 182*b* can be seen.

Disposed between platform 150 and plate 180 are torque tube mounts 190 (FIGS. 10) and 192, which has torque tube 194 connecting them.

Figure 10:
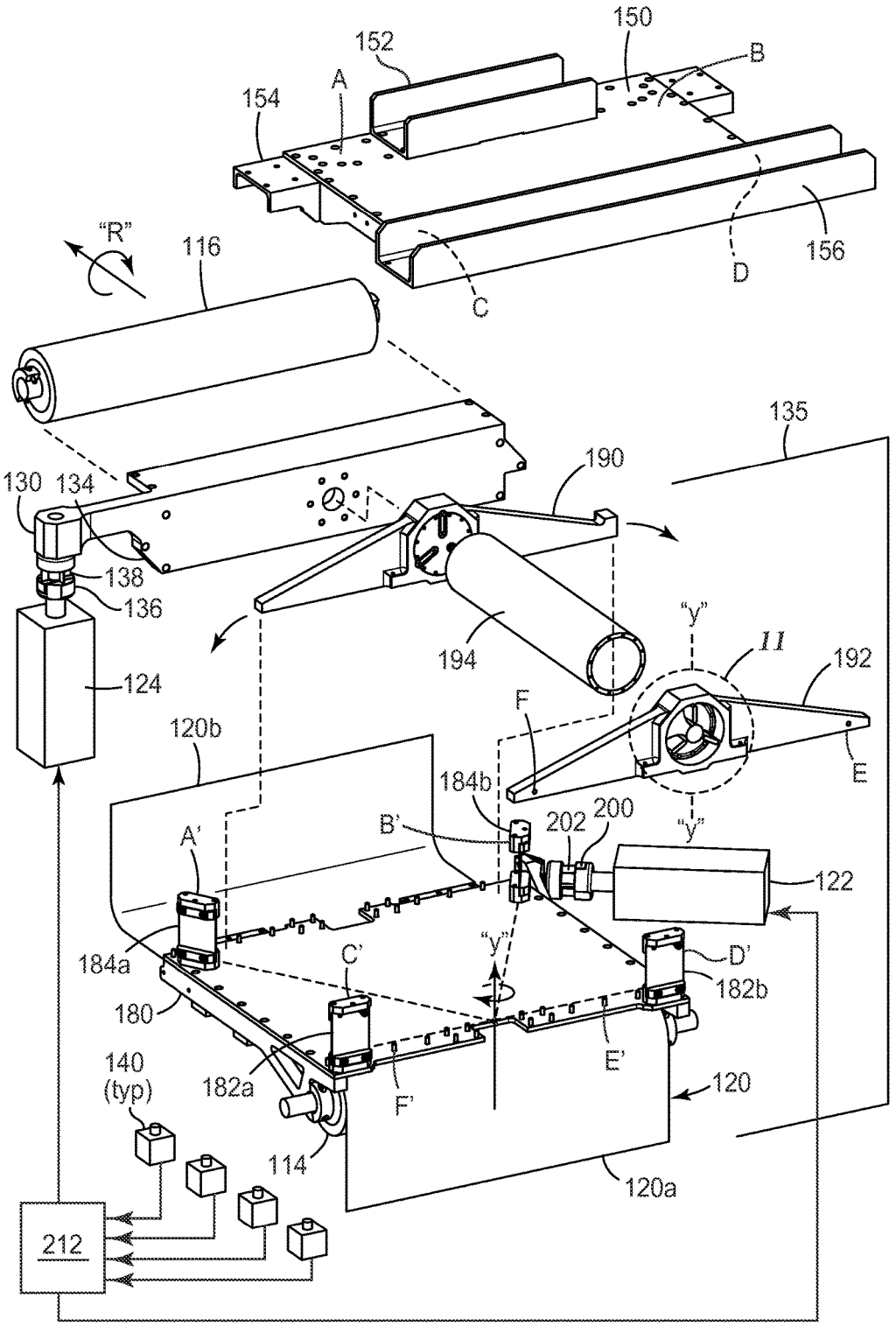
FIG. 10 is a perspective exploded view of the web steering apparatus of FIG. 7.

Referring now to FIG. 10, is a perspective exploded view of the web steering apparatus 100 of FIG. 7 is illustrated. To clarify how the separated parts are assembled, reference point A is attached to reference point A', and similarly for reference points B, C, D, E, and F and their counterparts reference points B', C', D', E', and F'. In this view it can be appreciated that yaw-axis actuator 122 manipulates the rotational position of plate 180 (yaw-axis rotation frame), connected to it via coupler 200 which conveniently uses flexures 202. Thus, actuator 122 rotates both first steering roller 114 (entry roll) and second steering roller 116 (exit roller) about the yaw-axis, "Y". Coupling 200 is rigid along the actuation axis, but uses flexures 202 to allow for actuator angular misalignment and lateral motion caused by movement of the plate 180 by yaw-rotation. In some convenient embodiments, the yaw-axis actuator 122 travel is limited at the extremities by hard stops to assure coupling integrity.

Plates 180, and therefore both steering rollers, rotate about a virtual pivot point established by the pairs of flexures 182 and 184. As seen, flexures 184*a* and 184*b* are disposed on a first side of plate 180 orientated at an angle of approximately 45 degrees to the first side. Flexures 182*a* and 182*b* are disposed on an opposing second side of plate 180 and orientated parallel to the second side at an angle of approximately 0 degrees. Thus, plate 180 has a flexure located at each corner of the plate, which attaches the plate to the platform 150, with a first pair of flexures orientated at 45 degrees disposed on the first side and a second pair of flexures oriented at 0 degrees disposed on the opposing second side. Four lines, with one line drawn tangent to each flexure in the plane of the plate, intersect at the virtual pivot point. A vertical axis though this virtual pivot point establishes the yaw-axis "Y" about which the plate rotates when moved by the yaw-axis actuator 122.

Suitable blocking clamps at each end of the flexures attach the plate 180 to one end of the flexure and the flexure to the appropriate location on the platform 150. Yaw-axis actuator 122 has the working end attached to the plate 180 by a suitable bracket such that its line of actuation is approximately at a 90 degree angle to a line tangent to flexure 184*b*. This provides maximum leverage for rotating the plate about the yaw-axis.

Flexure set 182*a* and 182*b* and flexure set 184*a* and 184*b*, spaced apart from each other and orientated as shown in combination with the torque tube and roll axis frame 130 eliminate translational or rotational movements of roller 116 in any other direction other than yaw about the "Y" axis and roll about the "R" axis. However, the ordinary artisan will perceive it is possible to use other precision elements such as preloaded bearings or bushings to provide a roller with yaw and rotation motion while simultaneously constraining all other translations and rotations.

Figure 11:
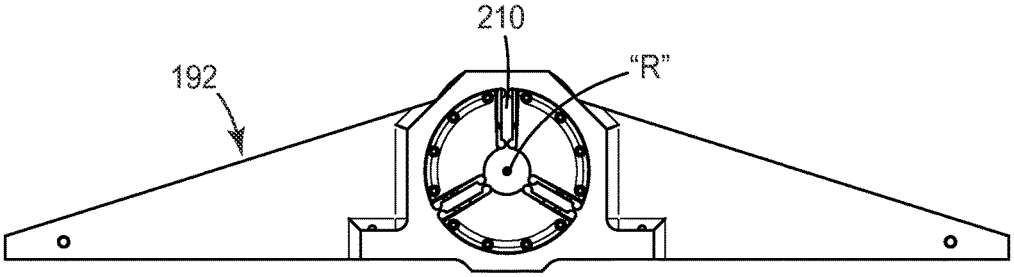
FIG. 11 is a detail view of a torque tube mount according to detail 11 in FIG. 10.

Torque tube mount 190 is attached to the plate 180 along the first side between flexures 184*a* and 184*b*. Torque tube mount 192 is attached to the plate 180 along the opposing second side between flexures 182*a* and 182*b*. Torque tube 194 is bolted at each end to a flexure assembly in each torque tube mount which allows for rotation of the torque tube relative to the torque tube mounts. As seen in FIG. 11, a detail view of torque tube mount 192 illustrates one convenient way of providing flexures 200 that provide rotational movement around roll-axis "R" without backlash. Each flexure assembly has three equally spaced flexures that connect a central conical section that terminates in a flat mounting surface for attachment of the torque tube. The flexure assembly in torque tube mount 190 is provided with a second mounting plate for bolting the roll-axis frame 130 to the torque tube. Thus the illustrated rotation system is quite rigid with no mechanical backlash for controlling roll of the second steering roller 116 about the roll-axis R.

Also shown in FIG. 10 is a controller 212, such a programmable logic controller, which has an input from each web position sensor 140 and an output to the roll-axis actuator 124 and an output to the yaw-axis actuator 122. The PLC can use PID control loops for position, velocity and force, utilizing the previously discussed fourth order differential beam equation to guide the web 120 to a desired location for further processing by moving the actuators in a controlled fashion. It is desirable that the PID loops be well tuned and use prediction and feed-forward control where possible. Advanced algorithms can be used in the final outer loop to establish the actuator's final position command. Control techniques as described are readily known to control engineers. The programmed controller in combination with the actuators and mechanical components moves the steering rollers to control the angular orientation and lateral position of the web at a particular or chosen position along the web path downstream of the second steering roller.

Other modifications and variations to the present disclosure may be practiced by those of ordinary skill in the art, without departing from the spirit and scope of the present disclosure, which is more particularly set forth in the appended claims. It is understood that aspects of the various embodiments may be interchanged in whole or part or combined with other aspects of the various embodiments. All cited references, patents, or patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A method of steering a web comprising:

conveying, via a web path comprising a steering roller, the web along a machine direction;

providing an array of position sensors adjacent to the web, the array of position sensors being arranged along the machine direction and adjacent to the steering roller, and configured to monitor a plurality of lateral positions of the web along the machine direction;

calculating an angular orientation of the web with respect to the machine direction by solving a plurality of position equations using the plurality of lateral positions as input; and controlling the angular orientation of the web comprising:

moving the steering roller about a yaw-axis perpendicular to the surface of the web;

moving the steering roller about a roll-axis parallel to the surface of the web; and guiding the web to a chosen position along a web path downstream of the steering roller.

2. The method according to claim 1 wherein the array of position sensors comprises four position sensors spaced along the web.

3. The method according to claim 2 wherein solving the plurality of position equations comprises solving four position equations for the lateral dynamics of a moving web.

4. The method according to claim 1 wherein solving the plurality of position equations comprises solving two position equations for the lateral dynamics of a moving web.

5. The method according to claim 1 wherein solving the plurality of position equations comprises solving three position equations for the lateral dynamics of a moving web.

6. The method according to claim 1 wherein the web comprises a tracking fiducial and the position sensors monitor the position of the tracking fiducial.

7. An apparatus for steering a web that is conveyed along a machine direction, the apparatus comprising:

a web path comprising at least one steering roller and an exit roller, each having a mount; wherein the at least one steering roller has an axis of rotation and wherein the mount for the at least one steering roller can pivot and/or translate the axis of rotation with a total of two degrees of freedom;

an array of position sensors arranged along the machine direction and adjacent to the at least one steering roller, configured to sense a plurality of lateral positions of the web along the machine direction;

a controller connected to the array and configured to receive the plurality of lateral positions and determine an angular orientation of the web with respect to the machine direction based on the plurality of lateral positions;

two actuators operably connected to the at least one steering roller for positioning the at least one steering roller to control the angular orientation and the lateral position of the web at a particular point along the web path; and a first steering roller and a second steering roller mounted to a yaw-axis rotation frame, wherein the at least one steering roller comprises the first steering roller and the second steering roller, and further comprising a roll-axis frame attaching the second steering roller to the yaw-axis rotation frame, wherein the roll-axis frame is attached to a pair of torque tube mounts positioned on the yaw-axis rotation frame with a torque tube connected between them.

8. An apparatus for steering a web that is conveyed along a machine direction, the apparatus comprising:

a web path comprising at least one steering roller and an exit roller, each having a mount; wherein the at least one steering roller has an axis of rotation and wherein the mount for the at least one steering roller can pivot and/or translate the axis of rotation with a total of two degrees of freedom;

an array of position sensors arranged along the machine direction and adjacent to the at least one steering roller, configured to sense a plurality of lateral positions of the web along the machine direction;

a controller connected to the array and configured to receive the plurality of lateral positions and determine an angular orientation of the web with respect to the machine direction based on the plurality of lateral positions;

two actuators operably connected to the at least one steering roller for positioning the at least one steering roller to control the angular orientation and the lateral position of the web at a particular point along the web path; and an unwinding roll, and wherein the unwinding roll and the at least one steering roller are both mounted on a laterally shifting frame with the at least one steering roller further rotatable mounted to the laterally shifting frame for rotation about a roll-axis parallel to the surface of the unwinding web.

* * * * *